US010433705B2

(12) United States Patent
Wilson et al.

(10) Patent No.: US 10,433,705 B2
(45) **Date of Patent: *Oct. 8, 2019**

(54) DISHWASHER RACK SYSTEM

(71) Applicant: Midea Group Co., Ltd., Beijiao, Shunde, Foshan (CN)

(72) Inventors: Mark W. Wilson, Simpsonville, KY (US); Timothy Martin Wetzel, Louisville, KY (US)

(73) Assignee: MIDEA GROUP CO., LTD., Beijiao, Shunde, Foshan, Guangdong (CN)

( * ) Notice: Subject to any disclaimer, the term of this patent is extended or adjusted under 35 U.S.C. 154(b) by 0 days.

This patent is subject to a terminal disclaimer.

(21) Appl. No.: 16/225,932

(22) Filed: Dec. 19, 2018

(65) Prior Publication Data

US 2019/0117038 A1 Apr. 25, 2019

Related U.S. Application Data

(62) Division of application No. 15/391,738, filed on Dec. 27, 2016, now Pat. No. 10,159,398.

(51) Int. Cl.
*A47L 15/50* (2006.01)
*A47L 15/46* (2006.01)

(52) U.S. Cl.
CPC ..... *A47L 15/507* (2013.01); *A47L 15/46* (2013.01)

(58) Field of Classification Search
CPC ..... A47L 15/507; A47L 15/46
See application file for complete search history.

(56) References Cited

U.S. PATENT DOCUMENTS

| | | | |
|---|---|---|---|
| 3,005,672 | A | 10/1961 | Becker |
| 3,466,105 | A | 9/1969 | Guth |
| 3,726,580 | A | 4/1973 | Guth |
| 3,809,450 | A | 5/1974 | Guth |
| 3,822,085 | A | 7/1974 | Clark |
| 3,892,453 | A | 7/1975 | Daily |
| 3,982,801 | A | 9/1976 | Heidorn et al. |
| 4,097,099 | A | 6/1978 | Spiegel |
| 4,644,693 | A | 2/1987 | Wang |
| 5,115,822 | A | 5/1992 | Nichols |
| 5,409,309 | A | 4/1995 | Giddings et al. |
| 5,474,378 | A | 12/1995 | Smith et al. |
| 5,595,200 | A | 1/1997 | Favaro |
| 5,657,878 | A | 8/1997 | Austin |

(Continued)

FOREIGN PATENT DOCUMENTS

| | | | |
|---|---|---|---|
| CA | 2394277 | A1 | 2/2003 |
| CA | 2582685 | A1 | 5/2008 |

(Continued)

OTHER PUBLICATIONS

Dean Dobson, Bethany Hyvarinen, Katie Roberts, "Ergonomically Sound Design of a Bottom Dishwasher Rack," Dec. 2002.

(Continued)

*Primary Examiner* — Hanh V Tran
(74) *Attorney, Agent, or Firm* — Middleton Reutlinger

(57) ABSTRACT

A dishwasher rack for a dish washing appliance. The dishwasher rack may be positionable between a stowed position and a deployed position. A motor may drive the dishwasher rack. The motor may be coupled to the dishwasher rack by a rack and pinion, a worm screw, and/or the like. The dishwasher rack may be in a manual configuration and/or automatic configuration.

14 Claims, 11 Drawing Sheets

(56) References Cited

U.S. PATENT DOCUMENTS

| | | | |
|---|---|---|---|
| 5,971,513 | A | 10/1999 | Cassalia |
| 6,142,551 | A | 11/2000 | Ciavaglia et al. |
| 6,223,469 | B1 | 5/2001 | Moll |
| 6,247,771 | B1 | 6/2001 | Miller |
| 6,523,919 | B1 | 2/2003 | Israelsen et al. |
| 6,571,808 | B2 | 6/2003 | Todd |
| 6,755,490 | B2 | 6/2004 | Welch et al. |
| 7,424,893 | B2 | 9/2008 | Kim |
| 7,628,461 | B2 | 12/2009 | Carden et al. |
| 8,061,790 | B2 | 11/2011 | Anikhindi et al. |
| 8,067,915 | B2 | 11/2011 | Hooker et al. |
| 8,162,419 | B2 | 4/2012 | Dellby et al. |
| 8,172,347 | B2 | 5/2012 | Lim et al. |
| 8,283,610 | B2 | 10/2012 | Hirano |
| 8,303,053 | B2 | 11/2012 | Bond et al. |
| 8,668,289 | B2 | 3/2014 | Lee et al. |
| 8,813,766 | B2 | 8/2014 | Bhajak et al. |
| 8,852,351 | B2 | 10/2014 | Tuller |
| 9,121,217 | B1 | 9/2015 | Hoffberg |
| 9,420,882 | B2 | 8/2016 | Garcia et al. |
| 9,510,676 | B2 | 12/2016 | Tarcy |
| 9,895,046 | B1 | 2/2018 | Wilson et al. |
| 2003/0042825 | A1 | 3/2003 | Welch et al. |
| 2003/0106570 | A1 | 6/2003 | Cerruti |
| 2004/0163687 | A1 | 8/2004 | Son et al. |
| 2004/0244825 | A1 | 12/2004 | Ashton |
| 2006/0021373 | A1 | 2/2006 | Oh et al. |
| 2006/0043848 | A1 | 3/2006 | Jeong et al. |
| 2006/0164230 | A1 | 7/2006 | DeWind et al. |
| 2006/0242988 | A1 | 11/2006 | Kim et al. |
| 2008/0018215 | A1 | 1/2008 | Carden et al. |
| 2008/0129168 | A1 | 6/2008 | Banta et al. |
| 2008/0210272 | A1 | 9/2008 | Kaczmarek |
| 2009/0160297 | A1 | 6/2009 | Anikhindi et al. |
| 2009/0261704 | A1 | 10/2009 | Benz et al. |
| 2011/0247663 | A1 | 10/2011 | Gadini et al. |
| 2012/0074080 | A1 | 3/2012 | Garcia et al. |
| 2013/0125937 | A1 | 5/2013 | Baldwin et al. |
| 2014/0102491 | A1 | 4/2014 | Bhajak et al. |
| 2014/0132147 | A1 | 5/2014 | Tarcy |
| 2014/0137608 | A1 | 5/2014 | Seikel et al. |
| 2014/0227411 | A1 | 8/2014 | Popeil et al. |
| 2014/0246008 | A1 | 9/2014 | Martin |
| 2014/0318583 | A1 | 10/2014 | Hexam |
| 2014/0326794 | A1 | 11/2014 | Frank |
| 2015/0108162 | A1 | 4/2015 | Harter et al. |
| 2015/0173588 | A1 | 6/2015 | Bhajak et al. |
| 2016/0309982 | A1 | 10/2016 | Gerstner et al. |
| 2016/0331206 | A1 | 11/2016 | Gerstner et al. |
| 2017/0027413 | A1 | 2/2017 | Gerstner et al. |
| 2017/0135554 | A1 | 5/2017 | Park et al. |
| 2017/0202427 | A1 | 7/2017 | Chamarthi et al. |
| 2017/0202428 | A1 | 7/2017 | Kumar et al. |
| 2018/0177380 | A1 | 6/2018 | Wilson et al. |

FOREIGN PATENT DOCUMENTS

| | | | |
|---|---|---|---|
| CN | 101176640 | A | 5/2008 |
| CN | 106691350 | A | 5/2017 |
| EP | 1066789 | A1 | 1/2001 |
| EP | 1161917 | A3 | 1/2003 |
| JP | H0634777 | Y2 | 9/1994 |
| WO | 2014102367 | A1 | 7/2014 |
| WO | 2015091646 | A1 | 6/2015 |
| WO | 2015185230 | A1 | 12/2015 |

OTHER PUBLICATIONS

U.S. Patent and Trademark Office, Restriction issued in related U.S. Appl. No. 15/391,738 dated Nov. 2, 2017.

U.S. Patent and Trademark Office, Notice of Allowance issued in related U.S. Appl. No. 15/391,733 dated Oct. 16, 2017.

Transmittal of Related Applications dated Dec. 19, 2018.

U.S. Patent and Trademark Office, Non-Final Office Action issued in related U.S. Appl. No. 15/391,738 dated Apr. 3, 2018.

International Search Report and Written Opinion issued in Application No. PCT/CN2017/102079 dated Dec. 6, 2017.

International Search Report and Written Opinion issued in Application No. PCT/CN2017/102135 dated Dec. 1, 2017.

U.S. Patent and Trademark Office, Non-Final Office Action issued in related U.S. Appl. No. 15/899,029 dated Oct. 1, 2018.

U.S. Patent Office; Notice of Allowance issued in U.S. Appl. No. 15/391,738 dated Oct. 19, 2018.

U.S. Patent Office; Corrected Notice of Allowance issued in U.S. Appl. No. 15/391,738 dated Nov. 21, 2018.

U.S. Patent Office; Notice of Allowance issued in U.S. Appl. No. 15/899,029 dated Mar. 18, 2019.

International Search Report and Written Opinion issued in Application No. PCT/CN2019/075477 dated May 23, 2019.

DISHWASHER RACK SYSTEM

BACKGROUND

The present embodiments relate to an appliance rack or shelf, with particular embodiments shown for a dishwasher rack for a dishwasher appliance.

Typical dishwasher racks are coupled to the dishwasher door to move the rack out of or into the dishwasher tub. However, this practice often may position the dishwasher rack at an undesirable time and/or position relative to the door's position. Thus, there is a need for the dishwasher rack to be capable of extending out of and/or retracting into the dishwasher tub regardless of the position of the dishwasher door in some embodiments.

SUMMARY

In some embodiments of the invention, for example, a dish washing appliance may include a dishwasher tub. In various embodiments, the appliance may include at least one dishwasher rack that may be positioned within the dishwasher tub. In some embodiments, at least one dishwasher rack may be positionable between a stowed position and a deployed position along a horizontal plane. In various embodiments, the deployed position may be different from the stowed position. Moreover, in some embodiments, the appliance may include at least one motor. In addition, in some embodiments, the appliance may include a gear mechanism that may connect at least one motor to at least one dishwasher rack. In various embodiments, at least one dishwasher rack may be operable between the stowed position and the deployed position in at least one of an automatic configuration and a manual configuration. In some embodiments, when in the automatic configuration at least one motor may apply a first force to at least one dishwasher rack between the deployed position and the stowed position. Further in various embodiments, when in the manual configuration at least one motor may apply a second force to at least one dishwasher rack between the deployed position and the stowed position. Further in some embodiments, the second force may be less than the first force.

In various embodiments, the second force may be zero. In some embodiments, the appliance may include a clutch transitioning at least one dishwasher rack between the manual configuration and the automatic configuration. Moreover, in some embodiments, when in the manual configuration at least one motor may be disengaged from the gear mechanism. In some embodiments, when in the manual configuration at least one dishwasher rack may be disengaged from the gear mechanism. In various embodiments, the gear mechanism may be a worm screw. In various embodiments, the gear mechanism may be a rack and a pinion. In addition, in some embodiments, at least one dishwasher rack may be operable between the stowed position and the deployed position in the automatic configuration.

In some embodiments, a dish washing appliance may include a dishwasher tub. In some embodiments, the appliance may include one or more dishwasher racks positioned within the dishwasher tub. In various embodiments, at least one of the dishwasher racks may be positionable between a stowed position and a deployed position along a horizontal plane. In some embodiments, the deployed position may be different from the stowed position. Moreover, in some embodiments, the appliance may include at least one motor. In various embodiments, the appliance may include at least one worm screw that may be operably coupled to at least one motor. In some embodiments, the appliance may include at least one threaded member connected to at least one dishwasher rack and at least one worm screw. Moreover, in some embodiments, at least one threaded member may be positionable with at least one dishwasher rack between the stowed position and the deployed position.

In various embodiments, at least one dishwasher rack may include one or more wheels engaging at least one dishwasher rack to the dishwasher tub. In some embodiments, at least one dishwasher rack may include one or more slides engaging at least one dishwasher rack to the dishwasher tub. In addition, in some embodiments, the appliance may include a clutch between at least one dishwasher rack and at least one motor. In various embodiments, at least one threaded member may disengage from at least one dishwasher rack upon application of a manual force. In some embodiments, at least one threaded member may be magnetically coupled to at least one dishwasher rack. Moreover, in some embodiments, the appliance may include a controller in communication with at least one dishwasher rack.

In addition, in various embodiments, a dish washing appliance may include a dishwasher tub. In some embodiments, the appliance may include one or more dishwasher racks positioned within the dishwasher tub. Further in some embodiments, at least one of the dishwasher racks may be positionable between a stowed position and a deployed position along a horizontal plane. In various embodiments, the deployed position may be different from the stowed position. In some embodiments, the appliance may include at least one motor. Further in some embodiments, the appliance may include at least one pinion operably coupled to at least one motor. In various embodiments, the appliance may include at least one rack connected to at least one dishwasher rack and at least one pinion. Further in some embodiments, at least one rack may be positionable with at least one dishwasher rack between the stowed position and the deployed position.

In various embodiments, at least one dishwasher rack may include one or more wheels engaging at least one dishwasher rack to the dishwasher tub. In some embodiments, at least one dishwasher rack may include one or more slides engaging at least one dishwasher rack to the dishwasher tub. Moreover, in some embodiments, the appliance may include a clutch between at least one dishwasher rack and at least one motor. In various embodiments, the pinion may be magnetically coupled to at least one motor. Further, in some embodiments, at least one motor may be positioned outside the dishwasher tub.

These and other advantages and features, which characterize the embodiments, are set forth in the claims annexed hereto and form a further part hereof. However, for a better understanding of the embodiments, and of the advantages and objectives attained through its use, reference should be made to the drawings and to the accompanying descriptive matter, in which there are described example embodiments. This summary is merely provided to introduce a selection of concepts that are further described below in the detailed description, and is not intended to identify key or essential features of the claimed subject matter, nor is it intended to be used to limit the scope of the claimed subject matter, nor to define the field of endeavor.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION

Figure 1:
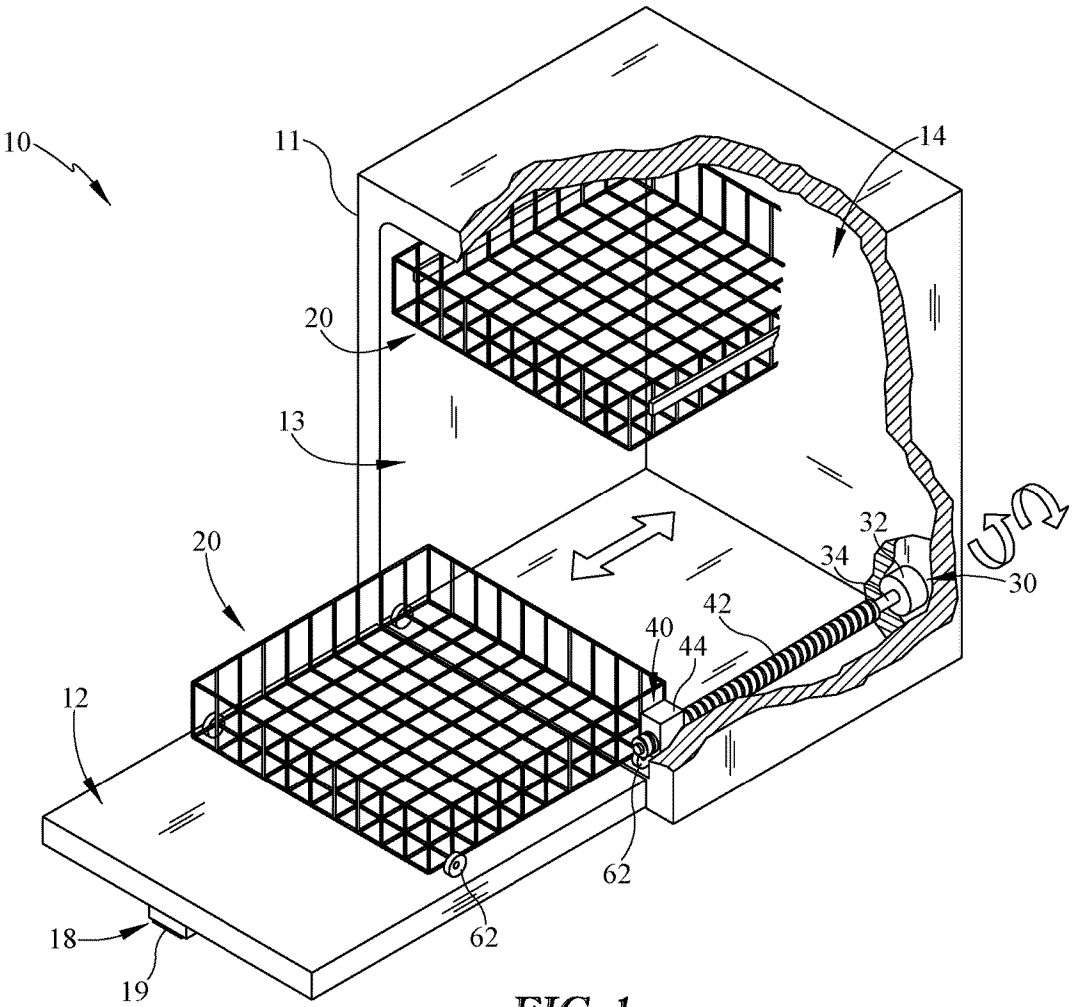
FIG. 1 is a perspective view of one embodiment of a lower dishwasher rack illustrating a deployed position, with portions of the housing, upper dishwasher rack, and dishwasher tub removed.

Numerous variations and modifications will be apparent to one of ordinary skill in the art, as will become apparent from the description below. Therefore, the invention is not limited to the specific implementations discussed herein.

The embodiments discussed hereinafter will focus on the implementation of the hereinafter-described techniques within a front-load residential dish washing machine such as dish washing appliance 10, such as the type that may be used in single-family or multi-family dwellings, or in other similar applications. However, it will be appreciated that the herein-described apparatus and techniques may also be used in connection with other types of dish washing machines in some embodiments. For example, the herein-described apparatus and techniques may be used in commercial applications in some embodiments. Moreover, the herein-described apparatus and techniques may be used in connection with other dish washing machine configurations. And even other appliances, such as, for example, ovens, refrigerators, and the like.

Embodiments for a dish washing machine are shown herein for ease of understanding. For example, a front-load dish washing machine that includes a front-mounted door 12 in a cabinet or housing 11 that provides access to a horizontally-oriented dishwasher rack 20 housed within the cabinet or housing 11 may be used. More specifically, the dishwasher rack 20 may be housed in a dishwasher tub 14. Implementation of the herein-described apparatus and techniques within a variety of appliances would be well within the abilities of one of ordinary skill in the art having the benefit of the instant disclosure, so the invention is not limited to the front-load dish washing implementation discussed further herein.

Turning now to the drawings, wherein like numbers denote like parts throughout the several views, FIG. 1 illustrates an example dish washing appliance 10 in which the various technologies and techniques described herein may be implemented. Dish washing appliance 10 is a front-load dish washing machine, and as such may include a front-mounted door 12 defining an opening 13 that provides access to a horizontally-oriented dishwasher tub 14. The door 12 may be coupled with a cabinet or housing 11 that may house the dishwasher tub 14 in some embodiments. Door 12 is generally hinged along a front or front edge of the housing 11 adjacent the opening 13 and is pivotable between the open position illustrated in FIGS. 1 and 3 and a closed position (not shown). When door 12 is in the open position, dishes, utensils, pans, and other washable items may be inserted into and removed from the one or more dishwasher racks 20 through the opening 13 in the front of cabinet or housing 11. Control over dish washing appliance 10, or more specifically the dishwasher racks 20, by a user is generally managed through a control panel 18 disposed on a door 12 and implementing a user interface 19 for the rack, and it will be appreciated that in different dish washing machine designs, control panel 18 may include various types of input and/or output devices, including various knobs, buttons, lights, switches, textual and/or graphical displays, touch screens, etc. through which a user may configure one or more settings and start and stop the dishwasher rack cycle or movement as described herein. For example, the control panel, or portions thereof, may be included with the dishwasher rack, on the interior or exterior of the door, and/or adjacent the rack within the opening of the dish washing machine. For example in some embodiments, portions of the controls may be accessible when the door is in the open position. In other embodiments, the one or more racks may open and/or close by proximity of one or more users and/or by a one or more gestures or bodily movement relative to the rack and/or portions of the dish washing machine.

As shown in the figures, the one or more dishwasher racks 20, or portions thereof, may be positionable relative to the dish washing appliance 10 between a stowed or un-deployed position (illustrated in solid lines) and a deployed or different position (illustrated in broken lines). At least one of the stowed positions of the dishwasher rack 20 may be used when one or more of the washing cycles is in operation. In use, the deployed position may be one or more horizontal positions different from one or more of the stowed positions. For example in one embodiment, one deployed position or partially opened position may be a position other than when the rack is in its fully extending position out of the dishwasher tub 14. One or more deployed positions may be a horizontal position to dry, load, and/or unload dishes, utensils, or the like. The one or more dishwasher racks 20 may travel in a substantially horizontal plane. The horizontal plane may be into and/or out of the dishwasher tub 14 or cavity. Although the substantially linear movement of the dishwasher rack cycle may occur along the horizontal plane as shown, the linear travel may be in a variety of angles and/or heights in one or both the directions into or out of a position. Further, one or more racks 20, or portions of one or more racks, may be driven between positions independently and/or dependently from another rack and/or portions of racks thereof. For example, one or more rack portions may move relative to the remaining rack portions before and/or after the remaining portions travel. Further, some dishwasher racks may move before and/or after another rack to correspond to a user's preference for example when loading and/or unloading the one or more dishwasher racks of the appliance 10.

The one or more dishwasher racks 20 may by positionable or operable in an automatic configuration and/or a manual configuration. The automatic configuration allows the dishwasher rack 20 to be power driven, with a sufficient force or a first force, between the stowed position and the deployed position. The automatic configuration may allow the dishwasher rack 20 to travel a variety of linear and/or nonlinear distances to and from a desired, preset or predetermined position without manual assistance from user. The manual configuration allows the user to override or bypass the automatic configuration. The manual configuration may reduce the power driven force, such as a second force from the drive mechanism, transferred to the rack 20. As a result the second force may be less than the first force transferred from the motor to the dishwasher rack 20. The power driven force may be reduced to substantially zero in the manual configuration, such as an embodiment where the user applies all the force to move the dishwasher rack between one or more positions without power assistance. As such in some embodiments of the manual configuration, the user may be assisted by at least some power for a duration of time and/or distance. In some embodiments, the conversion between the automatic configuration and the manual configuration may occur with the user adding user force to the dishwasher rack. Other embodiments may include a preset mode selected between the two configurations. Further, the automatic configuration may reengage or increase the applied power driven force to the rack when the user stops the user's assistance to move the rack. In some embodiments, the automatic configuration may be selected by the user when the door is open and/or closed via the control panel 18. Further, in some embodiments, one or more dishwasher racks, or portions of the rack, may be in an automatic configuration while other portions or another rack is in a manual configuration. Further in some embodiments, the appliance may have an automatic only configuration. In some embodiments, the appliance may have one rack that is only automatic and another rack that is manual. In addition for example, in some embodiments, one rack may be only automatic and another rack that may be operated between automatic and manual configurations. Further for example in some embodiments, the automatic configuration may be controlled by a variety of controlling mechanisms. For example, one embodiment may allow the user to touch or swipe one or more buttons to start and/or stop the fully-powered movement of the rack in the automatic configuration. In some embodiments, the user may be able to hold a button for a period of time coinciding with the racks movement in the automatic configuration. Once the button is released, the rack no longer has power-driven assistance.

In some embodiments, one or more dishwasher racks, or portions thereof, may be power driven by a variety of devices or drive mechanisms 30. As shown in the figures, in some embodiments one or more motors 32 may be used to open and/or close the one or more dishwasher racks 20 in an automatic configuration and/or assist the user's manual operation. The motor 32 may drive the dishwasher rack 20 between the stowed position and the deployed position. One embodiment may include an electric motor as shown with a drive shaft 34 projecting therefrom. The electric motor's rotation may correspond to the appropriate linear travel and/or direction of the dishwasher rack 20 in the horizontal plane. Although an electric motor is shown, it should be understood that a variety of actuators, i.e. mechanical, electro-mechanical, pneumatic, hydraulic, magnetic, pressure, or the like, may be used and still be within the scope of the invention to achieve the linear motion of the dishwasher rack.

In various embodiments, the dishwasher rack may be coupled to the drive mechanism 30 by a variety of linkages or gear mechanisms 40, 140. In various embodiments, the dishwasher rack 20 may include a gear mechanism 40 having at least a worm screw 42 as shown in FIGS. 1-7 operably coupled to the motor 32. Although not shown for example, one embodiment of the gear mechanism may include the worm screw 42 coupled with a worm wheel or a variety of gears transferring power from the motor 32 in some embodiments. In addition in some embodiments, the dishwasher rack 20 may include a gear mechanism 140 having a rack 46 and pinion 48 as shown in FIGS. 8-11 operably coupled to the motor 32. It should be understood that the gear mechanisms may be a variety of quantities, sizes, orientations, and constructions and still be within the scope of the invention.

In various embodiments, the dishwasher rack 20 may be disconnected and/or connected from the drive mechanism 30 by one or more clutches 50. The clutch 50 may be, but is not limited to, mechanical and/or magnetic couplings. The clutch 50 may function to engage and disengage the automatic configuration or power driven forces to the gear mechanism 40 and/or dishwasher rack 20 to retract and/or extend the dishwasher rack between positions. In various embodiments, the clutch 50 may disconnect or connect power from the drive mechanism 30 and/or separate portions of the gear mechanism 40 from each other relative to the dishwasher rack. It should be understood that a variety of clutches may be used, i.e. such as between the drive mechanism and the dishwasher rack, and still be within the scope of the invention.

As shown in the figures, in some embodiments the one or more racks 20 may include a variety of attachments 60 to engage the dishwasher tub 14. In some embodiments as shown in FIGS. 1, 3, 4, 6-8, and 10, the attachment 60 is in the form of one or more wheels 62 allowing the dishwasher rack 20 to roll between positions. Further, in some embodiments as shown in FIG. 7, the dishwasher rack 20 may include one or more rails or slides 64 engaging the dishwasher tub 14 allowing the linear travel of the dishwasher rack. In some embodiments, the rails or slides 64 may be coupled to the threaded member 44, rack 46 from the dishwasher rack 20. Although the engagement between the dishwasher tub 14 and the dishwasher rack 20 are shown in detail, a variety of attachments and/or mechanisms may be used to allow movement of the dishwasher rack relative to the dishwasher tub and still be within the scope of the invention disclosed herein.

Figure 2:
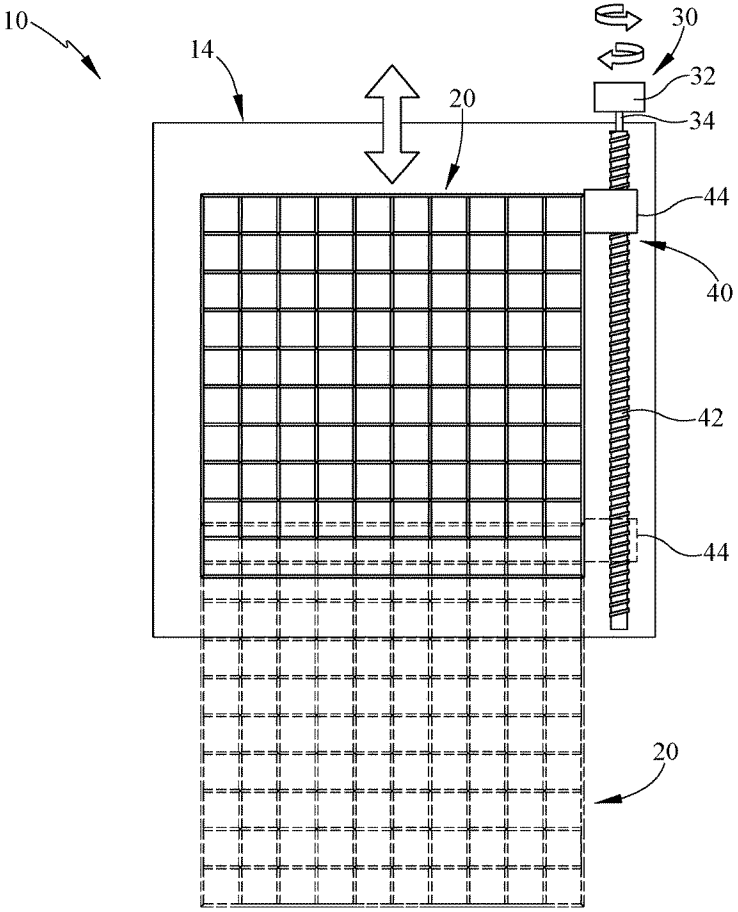
FIG. 2 is a schematic top view of the lower dishwasher rack of FIG. 1 illustrating the dishwasher rack in broken lines in a deployed position different from the stowed position, with the housing and door removed.
Figure 3:
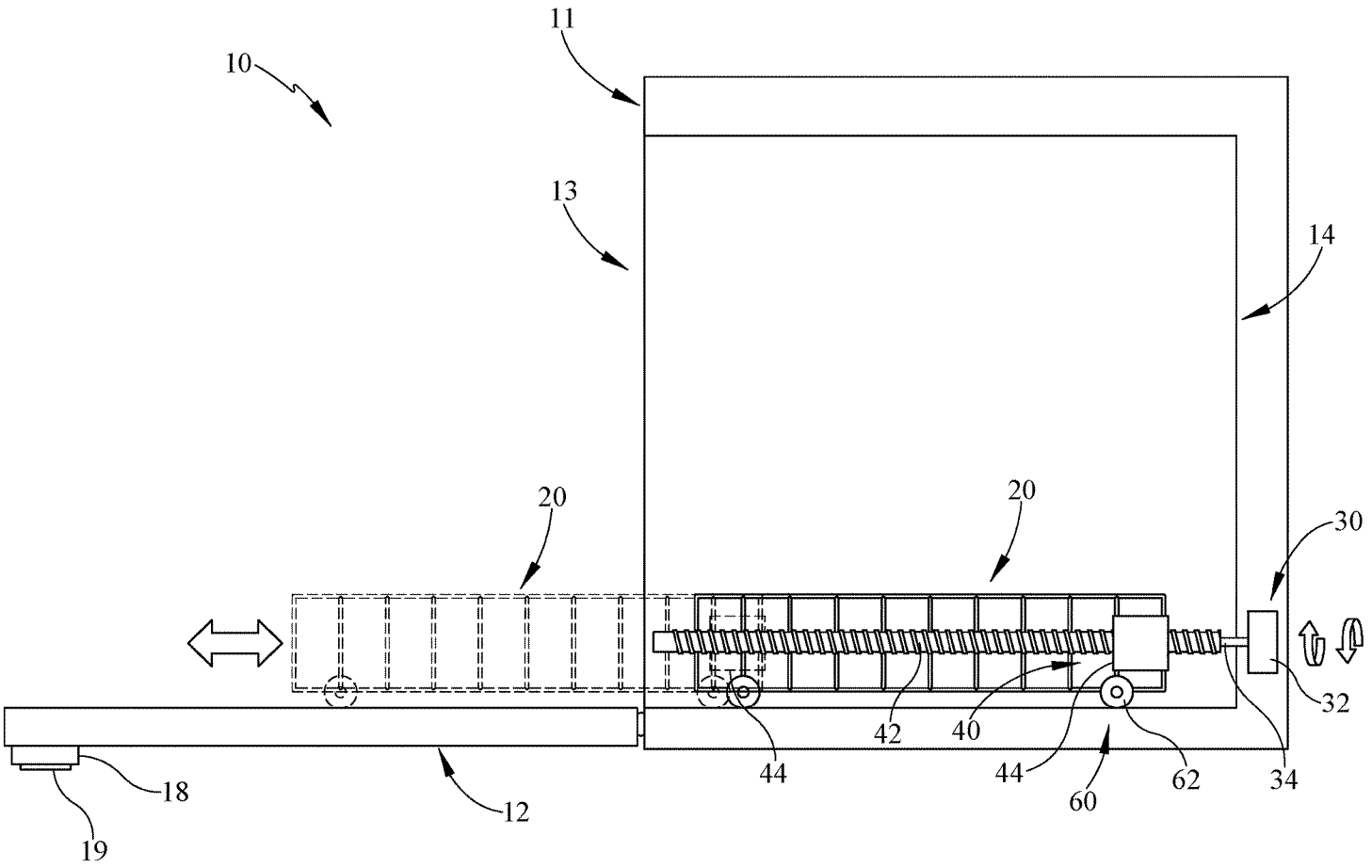
FIG. 3 is a schematic side view of the embodiment of FIG. 2, with the upper dishwasher rack removed.

As shown in FIGS. 1-3, one embodiment of the dishwasher rack 20 may be moveable in an automatic configuration between the deployed position (illustrated in broken lines) and the stowed position. The dishwasher rack 20 is coupled to the cavity of the dishwasher tub 14 by one or more wheels 62 allowing the linear movement. It should be understood that a variety of attachments 60 may still be used, such as, but not limited to slides 64. The motor 32 is coupled to a worm screw or threaded gear 42 via the motor drive shaft 34. In some embodiments, one or more worm screws 42 may be orientated in a substantially horizontal plane within the dishwasher tub 14. A threaded member 44 is connected to the dishwasher rack 20 and the worm screw 42. In one embodiment shown in figures, the motor 32 may be positioned outside the dishwasher tub 14 cavity. Although not shown, it is understood that the motor 32 may be positioned at least partially within the dishwasher tub 14 in some embodiments. The threaded member 44 may be attached the dishwasher rack 20 such that the threaded member 44 is positionable with the rack 20 between the stowed position and the deployed position. Although the threaded member 44 is shown as a block or nut with a threaded opening receiving the worm screw 42, a variety of threaded members may be used in different quantities, construction, shape, orientations and still operably engage the worm screw 42. For example, an exterior of the threaded member may be threaded to engage the worm screw in some embodiments. Rotation of the motor 32 may rotate the drive shaft 34 and worm screw 42 clockwise and/or counterclockwise. Because the threaded member 44 is fixed to the dishwasher rack 20, rotation of the worm screw moves (i.e. but not limited to linearly) the threaded member 44 and dishwasher rack 20 in the horizontal plane, depending on the direction of rotation. The electric motor 32 may be engaged in the appropriate rotational direction by a controller in some embodiments.

Figure 4:
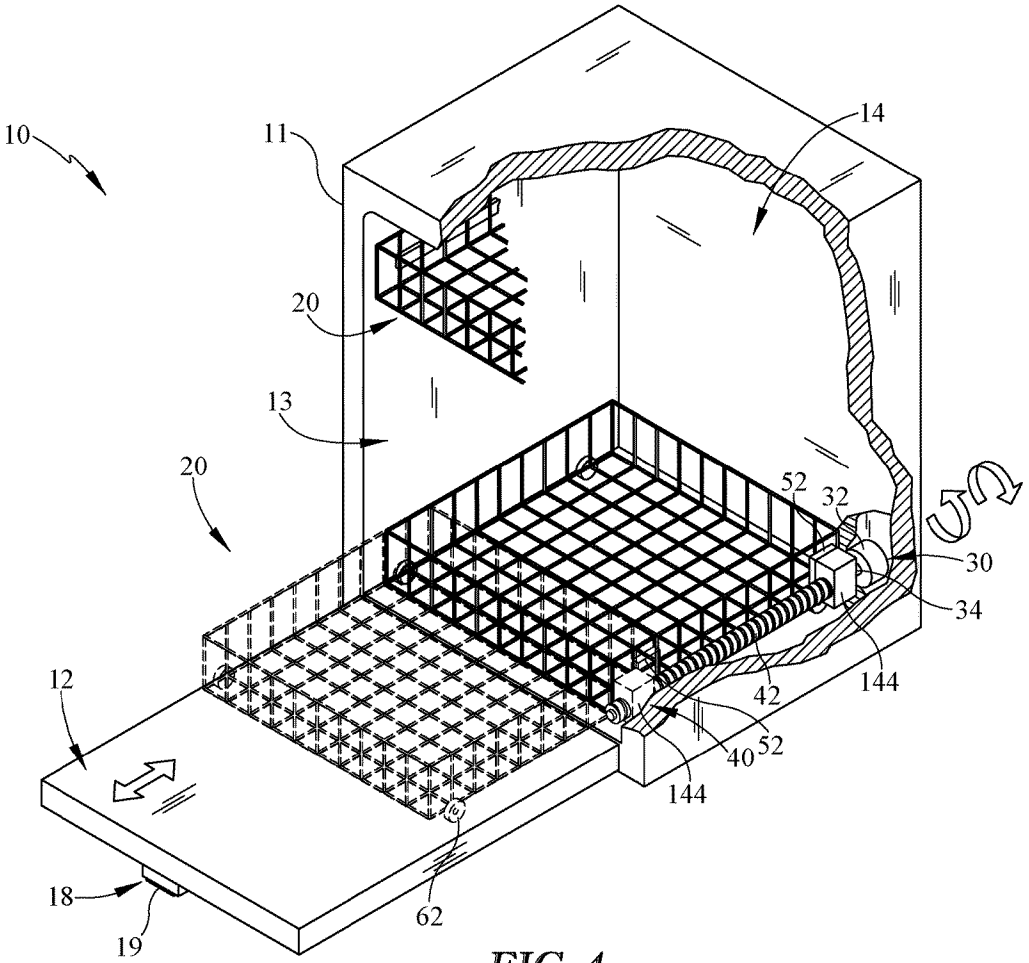
FIG. 4 is a perspective view of another embodiment of a dishwasher rack illustrating the lower dishwasher rack disconnected from the drive mechanism allowing the rack to freely move in one or more horizontal planes independent of the drive mechanism.
Figure 5:
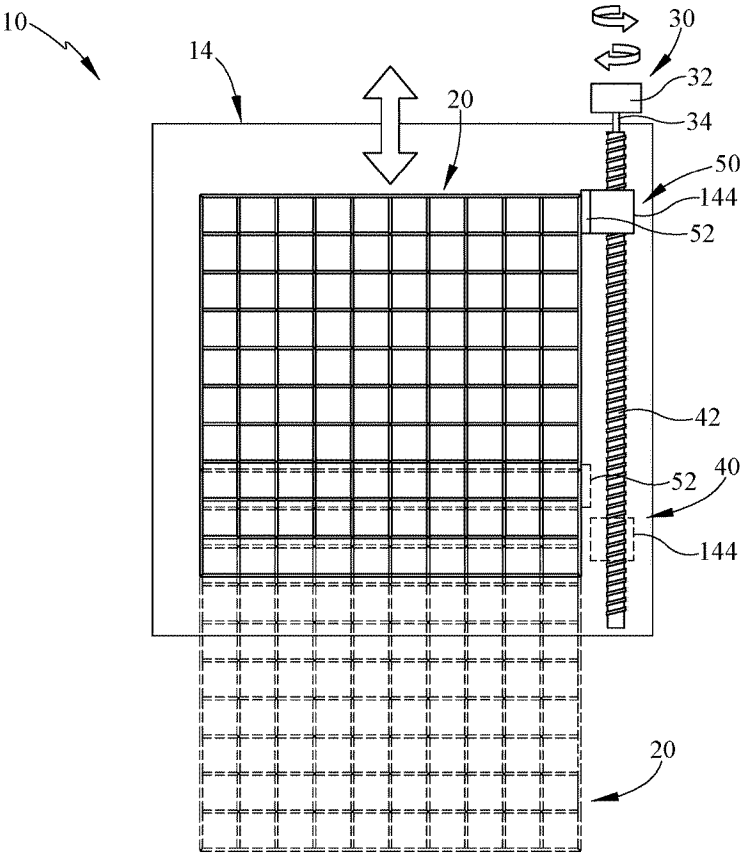
FIG. 5 is a schematic top view of the embodiment of FIG. 4 illustrating the deployed dishwasher rack in broken lines disconnected from the drive mechanism, with the housing and door removed.
Figure 6:
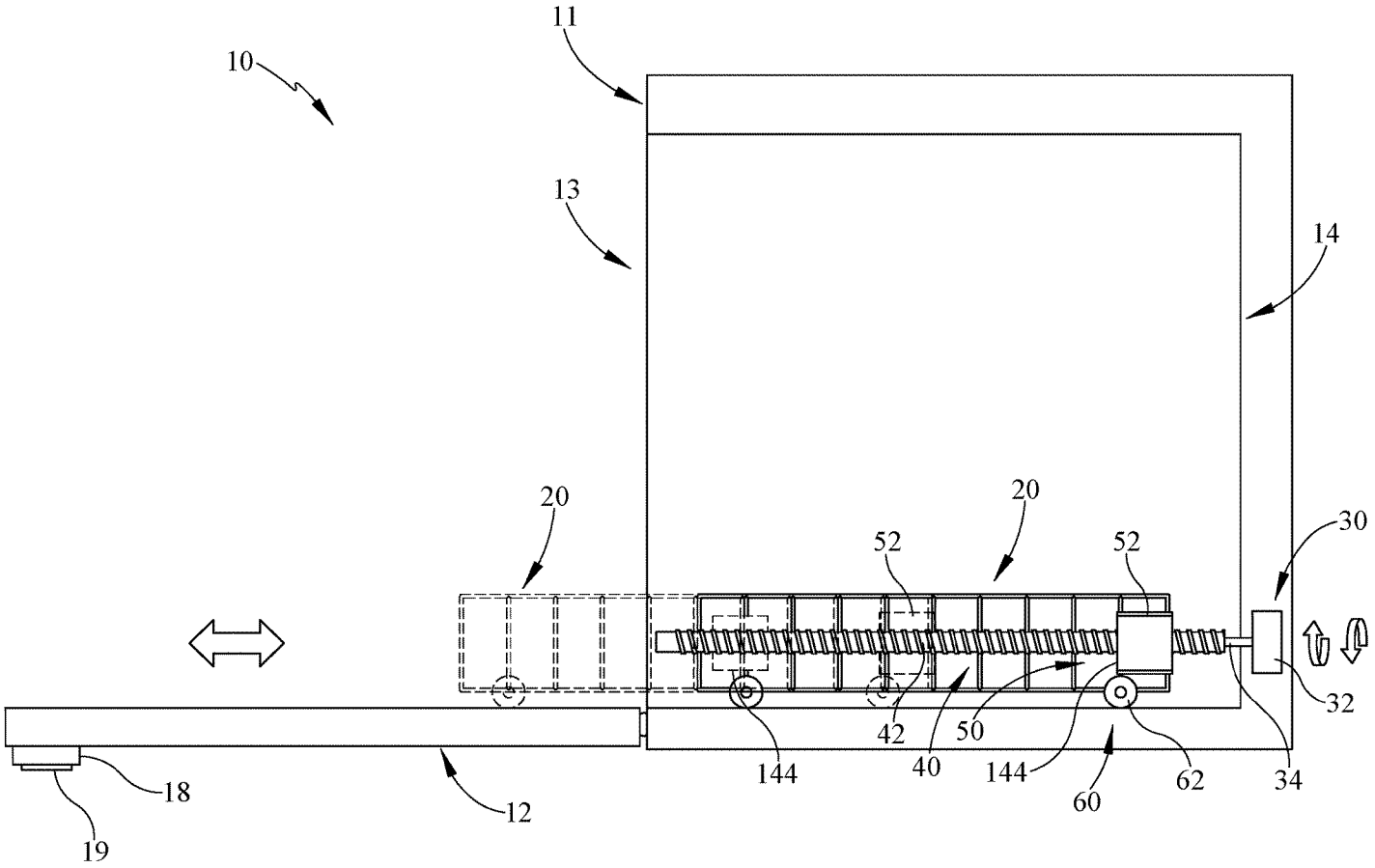
FIG. 6 is a schematic side view of the embodiment of FIG. 5, with the upper dishwasher rack removed.
Figure 7:
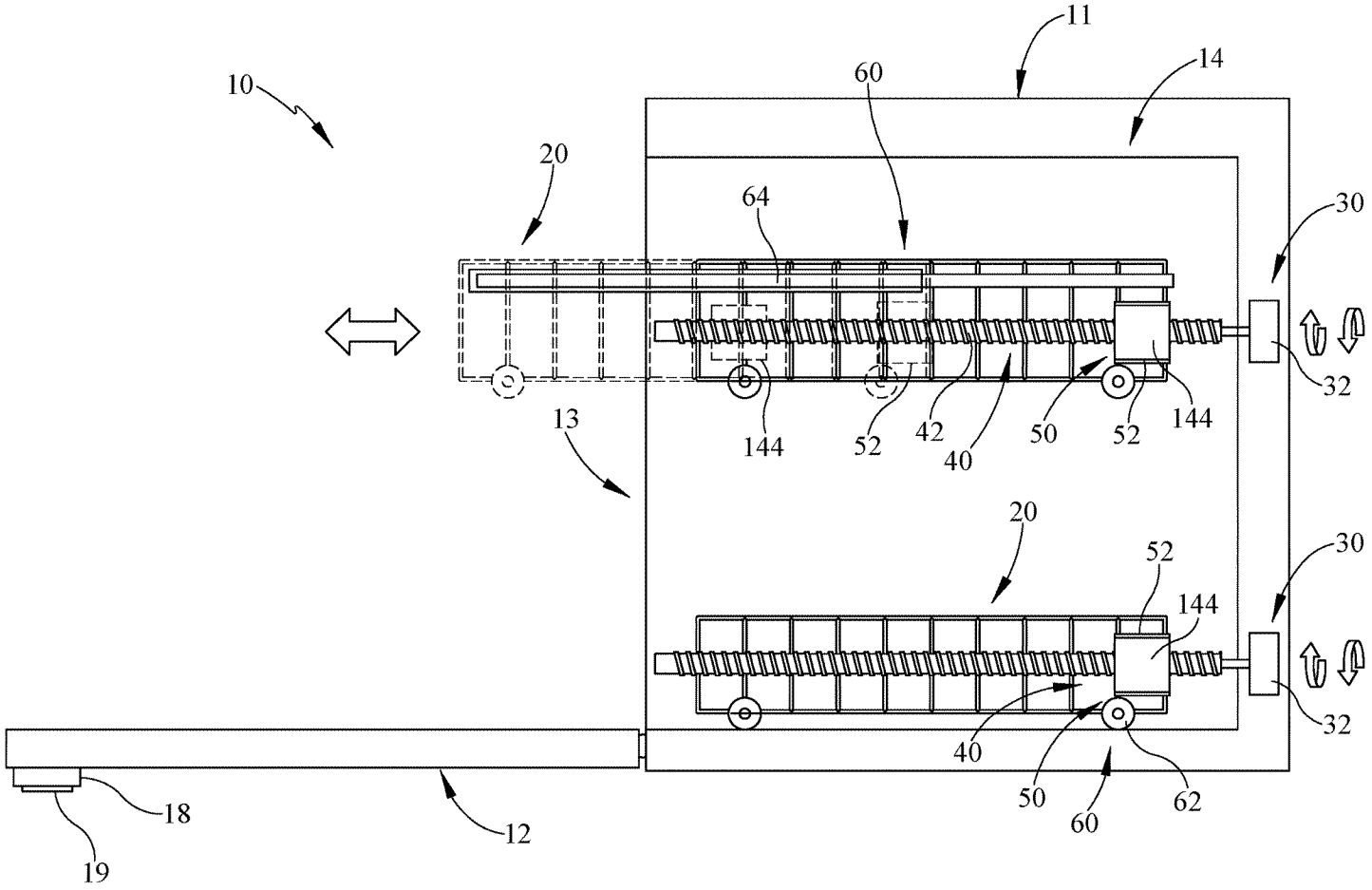
FIG. 7 is a schematic side view of the embodiment of FIG. 5 illustrating an upper dishwasher rack and a lower dishwasher rack, illustrating a variety of attachments to the dishwasher tub, with the deployed upper dishwasher rack in broken lines disconnected from the drive mechanism.

As shown in FIGS. 4-6, another embodiment of the rack 20 may be able to transition or override the automatic configuration of the dishwasher rack 20 to the manual configuration. The rack 20 may include a variety of clutches 50 to separate or disengage the motor 32 from driving the dishwasher rack 20 between the deployed and stowed positions. The powered assistance or first force supplied by the motor 32 may be reduced, or in some embodiments removed, when in the manual configuration. As is shown, the dishwasher rack 20 may have one or more fixed magnetic blocks 52 magnetically attached to another magnetic block 144, such as another embodiment of the threaded member. As such in use, when the user applies a sufficient manual force to the dishwasher rack 20, the magnetic force of attraction between the fixed magnetic block 52 and the magnetic block 144 may be overcome, and thus the dishwasher rack 20 and fixed magnetic block 52 may separate or disengage from the magnetic block or threaded member 144, worm screw 42, and/or motor 32. This allows the dishwasher rack 20 to be in the manual configuration. Once the clutch 50 is disengaged such that the auto configuration is overridden or bypassed, the clutch 50 can subsequently be reengaged with the drive mechanism 30 or motor 32. For instance in one embodiment, the clutch 50 may be reengaged when the threaded member or magnetic block 144 catches up to the location of the fixed magnetic block 52 and dishwasher rack 20 position.

Another embodiment of the dish washing appliance 10 is shown in FIG. 7, wherein the dishwasher tub 14 includes two or more racks 20. The lower dishwasher rack 20 may include the wheels 62 and the clutch 50. The lower dishwasher rack 20 is shown in the stowed position, with the clutch 50 still engaged. The upper rack may include the slides 64 and the clutch 50, with the clutch 50 shown disengaged in broken lines. The upper dishwasher rack 20 in a manual configuration illustrates the dishwasher rack 20 and fixed magnetic block 52 disconnected from the remaining portion of the gear mechanism 40, worm screw 42, magnetic block 144, and/or motor 32.

Figure 8:
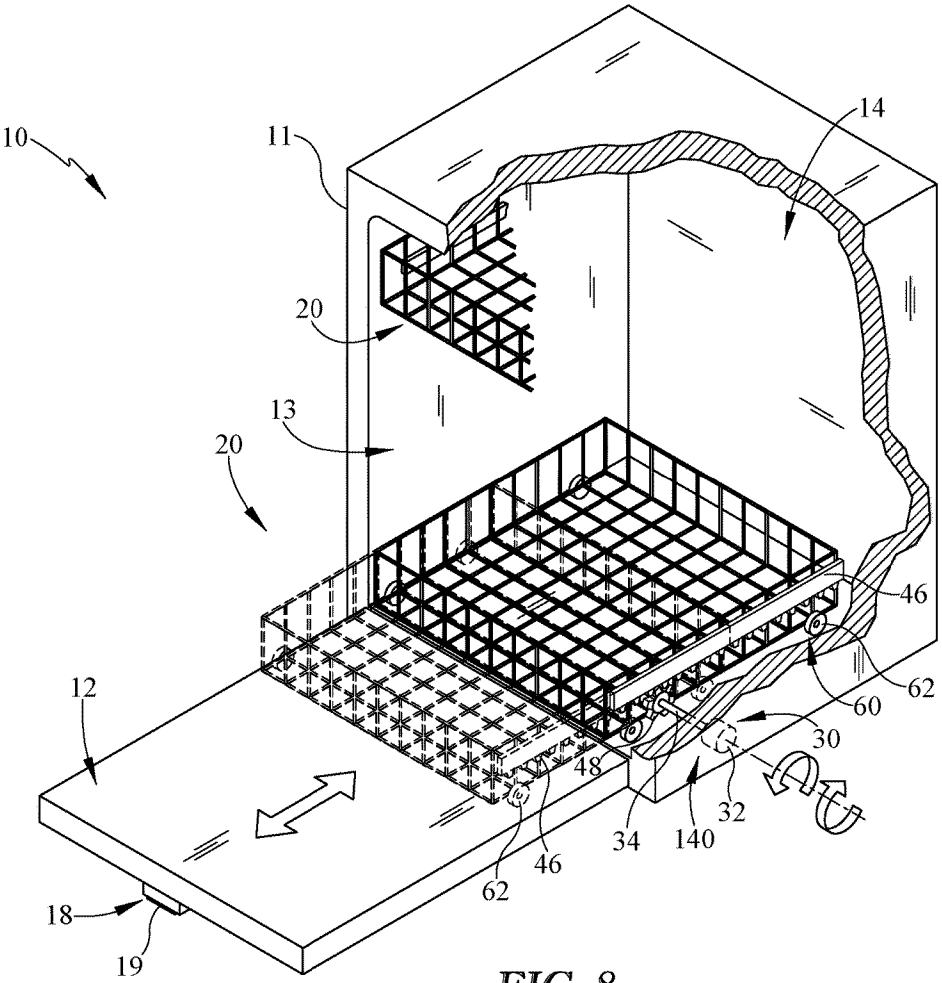
FIG. 8 is a perspective view of another embodiment of the dishwasher rack illustrating another embodiment of the gear mechanism, with the lower dishwasher rack in broken lines in a deployed position different from the stowed position and portions of the housing, upper dishwasher rack, and dishwasher tub removed.
Figure 9:
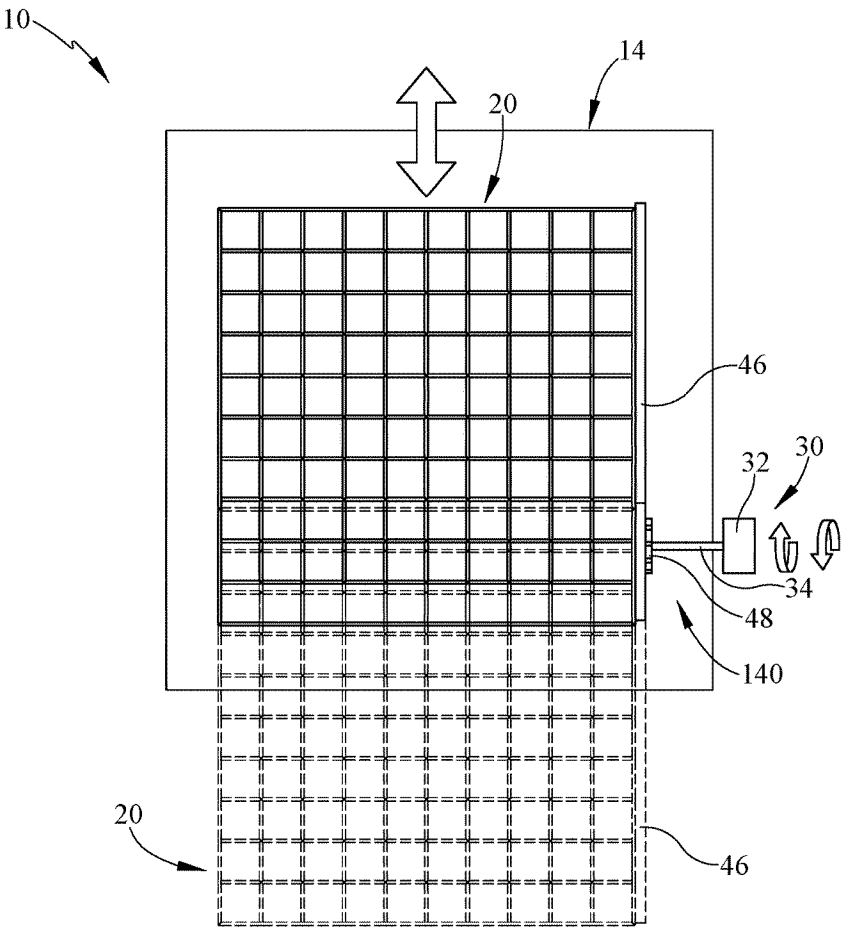
FIG. 9 is a schematic top view of the lower dishwasher rack of FIG. 8 illustrating the dishwasher rack in broken lines in a deployed position different from the stowed position, with the housing and door removed.
Figure 10:
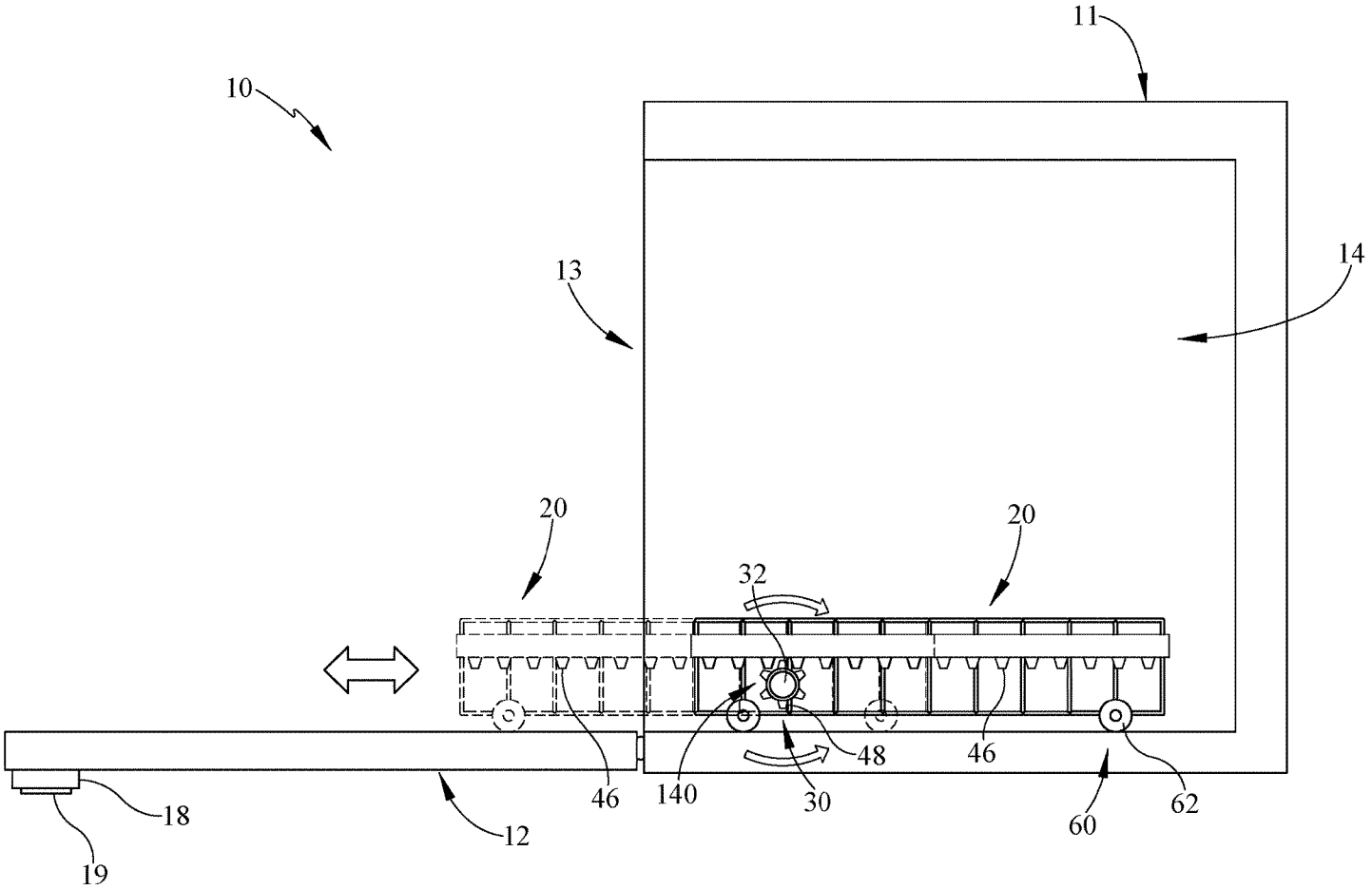
FIG. 10 is a schematic side view of the embodiment of FIG. 9, with the upper dishwasher removed.
Figure 11:
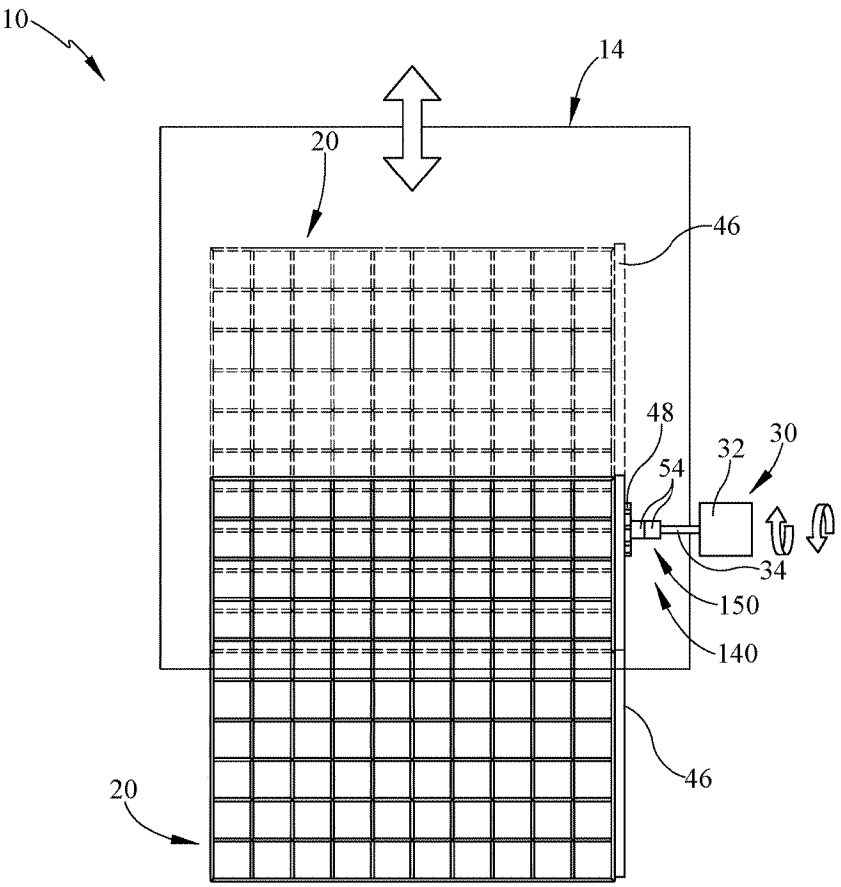
FIG. 11 is a schematic top view of another embodiment of the dishwasher rack of FIG. 9 illustrating the dishwasher rack in broken lines disconnected from the drive mechanism allowing the rack to freely move in the horizontal plane independent of the drive mechanism.

As shown in FIGS. 8-10 another embodiment of a gear mechanism 140, between the drive mechanism 30 and dishwasher rack 20, may be used with the dishwasher rack 20 in an automatic configuration between the deployed position (illustrated in broken lines) and the stowed position and include. The dishwasher rack 20 may be coupled to the motor 32 by the gear mechanism 140 that includes a rack 46 and pinion 48. The rack 46 may be fixed with the dishwasher rack 20 and travel linearly between the stowed position and the deployed position (illustrated in broken lines). The pinion 48 may be gear as is shown such that the rotation of the gear by the motor 32 translates the rack 46 and the dishwasher rack 20 laterally back and forth in the horizontal plane, depending on the rotational direction. Alternatively in some embodiments as shown in FIG. 11, the dishwasher rack 20 may also include another embodiment of the clutch 150 to bypass the automatic configuration resulting in a manual configuration. The clutch 150 as is shown may be a magnetic coupling 54 between the pinion 48 and the motor drive shaft 34. As such, when the dishwasher rack 20 is manually extended or retracted, the clutch 50 may bypass the drive mechanism 30. The clutch 150 may subsequently be reengaged to resume the automatic configuration.

Although the dishwasher rack 20 is shown schematically in the figures, it should be understood that the dishwasher rack may be a variety of sizes, shapes, quantities, and construction and still be within the scope of the teachings herein. For example, the dishwasher rack may have a first portion that may move within the horizontal plane separately and/or together with another portion of the rack in the horizontal plane.

In operation, embodiments of the dishwasher rack 20 may be operated by one or more control panels 18. As is shown in the embodiments, a control panel 18 may be outside the door 12. However, the control panels may be inside and/or outside the door. In use, the extension and/or retraction of the dishwasher rack may be selected by the user. The duration, one or more deployed positions, one or more stowed positions, distance of travel, retraction into the dishwasher tub, extension from the dishwasher tub, automatic configuration, manual configuration, and/or force to overcome the clutch to disengage and/or engage may be preset, determined upon characteristics of the dishwasher rack such as weight, size and/or quantity of items to be cleaned, capacity available and/or not available, or the like (i.e. loaded or unloaded conditions), or predetermined. Also, preprogrammed cycles or modes may also be used to position the dishwasher rack.

It should be understood that in some embodiments, dish washing appliance 10 and/or dishwasher rack 20 may be, in whole or in part, under the control of a controller (not shown) that receives inputs from a number of components and drives a number of components in response thereto. The controller may, for example, include one or more processors and a memory (not shown) within which may be stored program code for execution by the one or more processors. The memory may be embedded in the controller, but may also be considered to include volatile and/or non-volatile memories, cache memories, flash memories, programmable read-only memories, read-only memories, etc., as well as memory storage physically located elsewhere from controller, e.g., in a mass storage device or on a remote computer interfaced with a controller.

The controller may be interfaced with various components, including the aforementioned dishwasher tub 14, dishwasher rack 20, door 12, drive mechanism 30, gear mechanism 40, clutch 50, etc. In addition, controller may be coupled to a user interface 19 including various input/output devices such as knobs, dials, sliders, switches, buttons, lights, textual and/or graphics displays, touch screen displays, speakers, image capture devices, microphones, etc. for receiving input from and communicating with a user, e.g., as may be disposed in a control panel 18. In some embodiments, a controller may also be coupled to one or more network interfaces, e.g., for interfacing with external devices via wired and/or wireless networks such as Ethernet, Bluetooth, NFC, cellular, and other suitable networks. Additional components may also be interfaced with a controller, as will be appreciated by those of ordinary skill having the benefit of the instant disclosure. Moreover, in some embodiments, at least a portion of controller may be implemented externally from a dish washing machine, e.g., within a mobile device, a cloud computing environment, etc., such that at least a portion of the functionality described herein is implemented within the portion of the controller that is externally implemented.

In some embodiments, a controller may operate under the control of an operating system and may execute or otherwise rely upon various computer software applications, components, programs, objects, modules, data structures, etc. In addition, controller may also incorporate hardware logic to implement some or all of the functionality disclosed herein. Further, in some embodiments, the sequences of operations performed by controller to implement the embodiments disclosed herein may be implemented using program code including one or more instructions that are resident at various times in various memory and storage devices, and that, when read and executed by one or more hardware-based processors, perform the operations embodying desired functionality. Moreover, in some embodiments, such program code may be distributed as a program product in a variety of forms, and that the invention applies equally regardless of the particular type of computer readable media used to actually carry out the distribution, including, for example, non-transitory computer readable storage media. In addition, it will be appreciated that the various operations described herein may be combined, split, reordered, reversed, varied, omitted, parallelized and/or supplemented with other techniques known in the art, and therefore, the invention is not limited to the particular sequences of operations described herein.

While several embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings is/are used. Those skilled in the art will recognize, or be able to ascertain using no more than routine experimentation, many equivalents to the specific embodiments described herein. It is, therefore, to be understood that the foregoing embodiments are presented by way of example only and that, within the scope of the appended claims and equivalents thereto, embodiments may be practiced otherwise than as specifically described and claimed. Embodiments of the present disclosure are directed to each individual feature, system, article, material, and/or method described herein. In addition, any combination of two or more such features, systems, articles, materials, and/or methods, if such features, systems, articles, materials, and/or methods are not mutually inconsistent, is included within the scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of" or "exactly one of" "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

It is to be understood that the embodiments are not limited in its application to the details of construction and the arrangement of components set forth in the description or illustrated in the drawings. The invention is capable of other embodiments and of being practiced or of being carried out in various ways. Unless limited otherwise, the terms "connected," "coupled," "in communication with," and "mounted," and variations thereof herein are used broadly and encompass direct and indirect connections, couplings, and mountings. In addition, the terms "connected" and "coupled" and variations thereof are not restricted to physical or mechanical connections or couplings.

The foregoing description of several embodiments of the invention has been presented for purposes of illustration. It is not intended to be exhaustive or to limit the invention to the precise steps and/or forms disclosed, and obviously many modifications and variations are possible in light of the above teaching.

The invention claimed is:

1. A dish washing appliance comprising:

a dishwasher tub;

one or more dishwasher racks positioned within the dishwasher tub, at least one of the dishwasher racks is positionable between a stowed position and a deployed position along a horizontal plane, wherein the deployed position is different from the stowed position;

at least one motor;

at least one worm screw operably coupled to the at least one motor;

at least one threaded member connected to the at least one dishwasher rack and the at least one worm screw, wherein the at least one threaded member is positionable with the at least one dishwasher rack between the stowed position and the deployed position; and the at least one motor applies a drive force to the at least one dishwasher rack in both an automatic configuration and a manual configuration between the deployed position and the stowed position, wherein when in the manual configuration the at least one motor decreases the drive force corresponding to the increase in a user applied force to the at least one dishwasher rack in a direction of travel between the stowed position and the deployed position.

2. The dish washing appliance of claim 1 wherein the at least one dishwasher rack includes one or more wheels engaging the at least one dishwasher rack to the dishwasher tub.

3. The dish washing appliance of claim 1 wherein the at least one dishwasher rack includes one or more slides engaging the at least one dishwasher rack to the dishwasher tub.

4. The dish washing appliance of claim 1 further including a clutch between the at least one dishwasher rack and the at least one motor.

5. The dish washing appliance of claim 4 wherein the at least one threaded member disengages from the at least one dishwasher rack upon application of the user applied force.

6. The dish washing appliance of claim 4 wherein the at least one threaded member is magnetically coupled to the at least one dishwasher rack.

7. The dish washing appliance of claim 1 further including a controller in communication with the at least one dishwasher rack.

8. The dish washing appliance of claim 1 wherein the drive force of the at least one motor is zero when the user applied force is sufficient to move the at least one dishwasher rack between the deployed position and the stowed position in the direction of travel.

9. A dish washing appliance comprising:

a dishwasher tub;

at least one dishwasher rack positioned within the dishwasher tub, the at least one dishwasher rack positionable between a stowed position and a deployed position, wherein the deployed position is different from the stowed position;

at least one motor, wherein the at least one motor is positioned outside the dishwasher tub;

a gear mechanism connecting the at least one motor to the at least one dishwasher rack;

the at least one dishwasher rack is operable between the stowed position and the deployed position in at least one of an automatic configuration and a manual configuration;

when in the automatic configuration the at least one motor applies a first force to the at least one dishwasher rack between the deployed position and the stowed position; and when in the manual configuration the at least one motor applies a second force in addition to a user applied force to the at least one dishwasher rack between the deployed position and the stowed position, wherein the second force is less than the first force and greater than zero.

10. The dish washing appliance of claim 9 further comprising a clutch transitioning the at least one dishwasher rack between the manual configuration and the automatic configuration.

11. The dish washing appliance of claim 9 wherein the gear mechanism is a worm screw.

12. The dish washing appliance of claim 9 wherein the at least one dishwasher rack is operable between the stowed position and the deployed position in the automatic configuration.

13. The dish washing appliance of claim 9 wherein the at least one dishwasher rack includes one or more wheels engaging the at least one dishwasher rack to the dishwasher tub.

14. The dish washing appliance of claim 9 wherein the at least one dishwasher rack includes one or more slides engaging the at least one dishwasher rack to the dishwasher tub.

* * * * *